United States Patent [19]

Guild et al.

[11] 4,074,539

[45] Feb. 21, 1978

[54] EXPANSIBLE MANDREL WITH AN EXTERNAL, CABLE ACTUATING WINCH

[76] Inventors: Charles L. Guild, 7 Stone Tower Lane, Barrington, R.I. 02806; Goodman B. Willard, P.O. Box 62, Newport, Oreg. 97365

[21] Appl. No.: 725,952

[22] Filed: Sept. 23, 1976

[51] Int. Cl.[2] ..... E02D 7/30

[52] U.S. Cl. ..... 61/53.72

[58] Field of Search ..... 61/53.72, 53.7; 242/72; 279/2 R

[56] References Cited

U.S. PATENT DOCUMENTS 3,625,013 12/1971 Guild et al. ..... 61/53.72

*Primary Examiner*—Jacob Shapiro

[57] ABSTRACT

An expansible mandrel, for use in driving a tubular pile, has the pile-entering relationship of its lengthwise arcuate sections established by cable actuated means with separate cable actuated means operable to effect the pile-gripping relationship of the mandrel sections. One of the cables, in the disclosed embodiment, the retraction cable, is operated by a winch mounted on the outside of the mandrel at its upper end and driven in a winding direction by a motor, in the disclosed embodiment, an hydraulically operated motor.

12 Claims, 5 Drawing Figures

Fig. 1
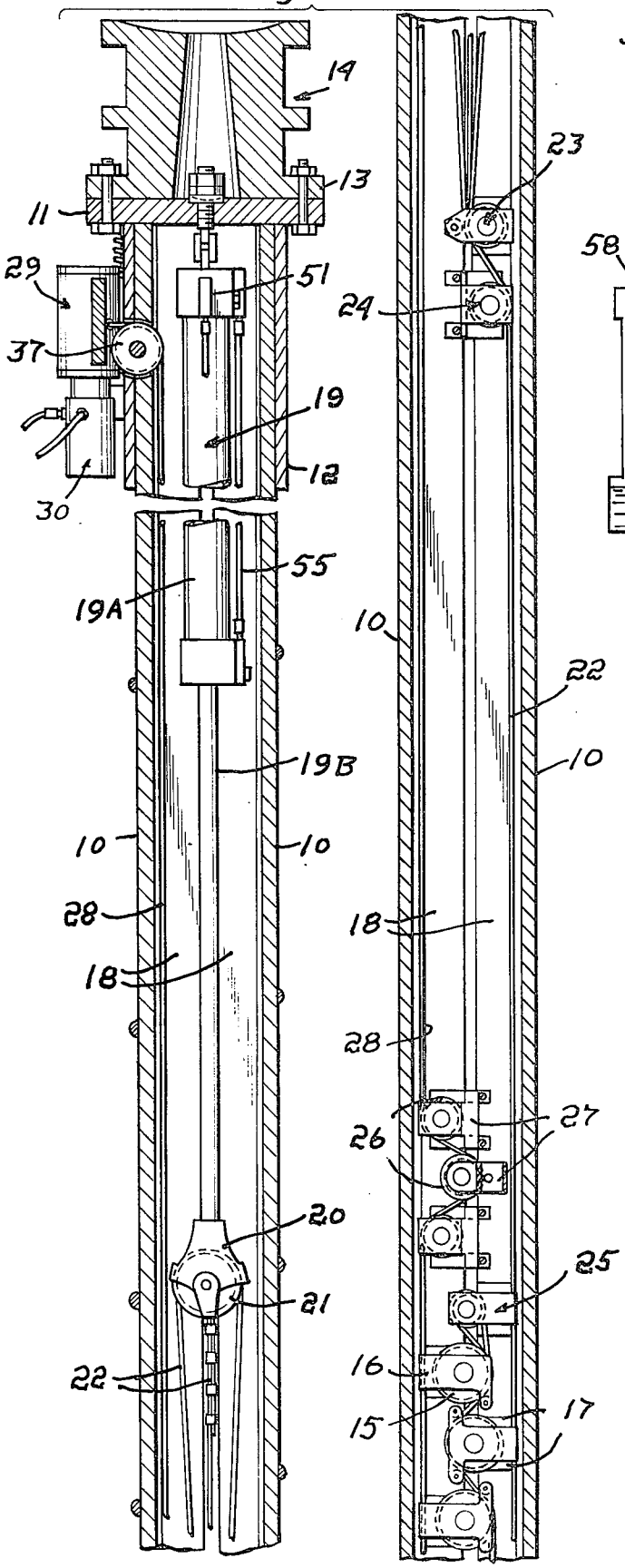
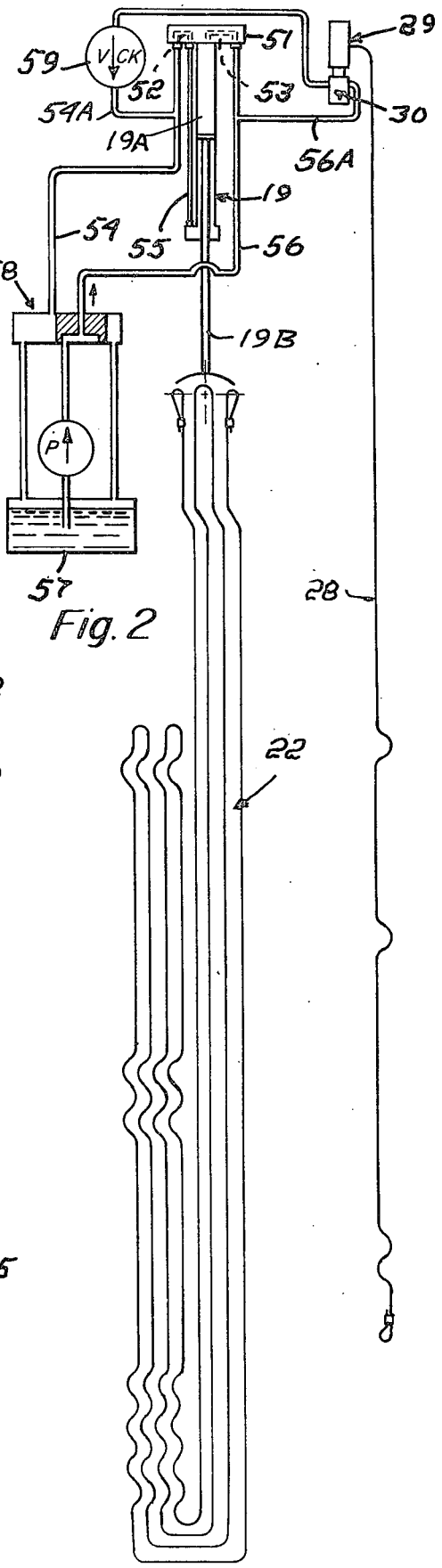
Fig. 2

EXPANSIBLE MANDREL WITH AN EXTERNAL, CABLE ACTUATING WINCH

RELATED APPLICATION

Ser. No. 695,259, Filed June 11, 1976 now U.S. Pat. No. 4,026,117.

BACKGROUND REFERENCES

U.S. Pat. No. 3,625,013
U.S. Pat. No. 3,779,026
U.S. Pat. No. 3,802,207
U.S. Pat. No. 3,803,854

BACKGROUND OF THE INVENTION

Expansible mandrels in accordance with said patents have proved to be advantageous in driving tubular piles, typically light gauge 18, 16, and 14 gauge corrugated shells and thin walled pipes, since the cable actuated sheave arrangements ensure that the mandrel, when expanded, securely grips the tubular pile throughout its full length.

This attribute of such mandrels has created problems of ensuring that the retracting means would always be capable of freeing the mandrel sections from their expanded, pile-gripping relationship and returning them to their retracted, pile-entering relationship, once the pile was driven. As disclosed in said application, this problem can best be met by providing the mandrels with a separate power operated device in control of a retraction cable in such trained engagement with sheaves that a pull on the retracting cable tends to straighten it and force the mandrel sections into their pile-entering relationship.

While the retraction unit may be located within the mandrel, it may also be located exteriorly thereof as may the unit for exerting a pull on the expansion cable and such options are desirable when space within the mandrel is limited, particularly in the case of the retraction unit because the expansion cable typically has a plurality of reeved courses and the expansion unit is a piston-cylinder unit having a relatively long stroke. In such cases, however, piston-cylinder units are not well suited for use and it is to the provision of suitable means for operating either one or both cables with power operated means on the outside of the mandrel that the present invention is also directed with such means preferably of an hydraulically operated type.

THE PRESENT INVENTION

The general objective of the present invention is to provide expansible mandrels of the type having either their pile-gripping relationship, their pile-entering relationship, or both effected by cables when subjected to pulls by power operated units connected thereto with minimum interference of the power operated units with the arrangement of the cable actuated mechanisms within the mandrel, an objective attained by providing that at least one of the units includes a winch and a motor therefor, preferably a hydraulic motor, that unit mounted on the outside of the mandrel adjacent its head with the winch drum exposed to the interior thereof in a manner enabling the appropriate cable to be connected thereto and wound thereon when the motor is operated to effect the appropriate relationship of the mandrel sections or unwound therefrom when the other relationship of the mandrel sections is being effected.

In practice, the means by which the pile-gripping relationship of the mandrel sections is effected is more complicated than that required to ensure that the mandrel sections are brought into their pile-entering relationship and, for that reason, it is usually preferred that the power operated unit by which the pile-gripping relationship is effected by a piston-cylinder unit located within the mandrel as the cable controlled thereby is, in practice, arranged to provide multi-courses and requiring substantial piston travel. Accordingly, the means by which the pile-entering relationship of the mandrel section is at least initiated may be advantageously located outside the mandrel.

Another important objective of the invention is to ensure that whatever power operated unit or units are located externally of the mandrel are not subjected, as a pile is being driven, to acceleration forces that could inpose objectionable service requirements, an objective attained by means supporting any cable-actuating unit mounted externally of the mandrel for limited movement relative thereto and provided with resilient means cushioning such forces, desirably in both vertical directions.

A particular objective of the invention is to provide that the winch-motor unit ensures appropriate control of the cable connected to the winch drum, an objective attained with the winch having a casing provided with a cylindrical first portion and a second internally threaded portion with a port between them. The winch motor has a shaft extending axially of said portions with the winch drum slidably splined thereto and having a cable storage portion and a threaded portion threaded into the threaded portion of the casing, the latter portion of greater axial extent than the threaded portion of the former. With this arrangement, the turn being wound on or unwound from the winch drum and passing through the casing port is always at the same substantially right angular relationship with the axis of the drum.

Other objectives of the invention will be apparent from the following detailed description of preferred embodiments thereof and from the appended claims.

BRIEF DESCRIPTION OF THE DRAWINGS

A preferred embodiment of the invention is illustrated by the accompanying drawings of which FIG. 1 is a vertical section of the upper portion of an expansible mandrel in accordance with the invention;

FIG. 2 is a somewhat schematic view showing the expansion and retraction cables and the means by which they are operated;

THE PREFERRED EMBODIMENT OF THE INVENTION

Figure 3:
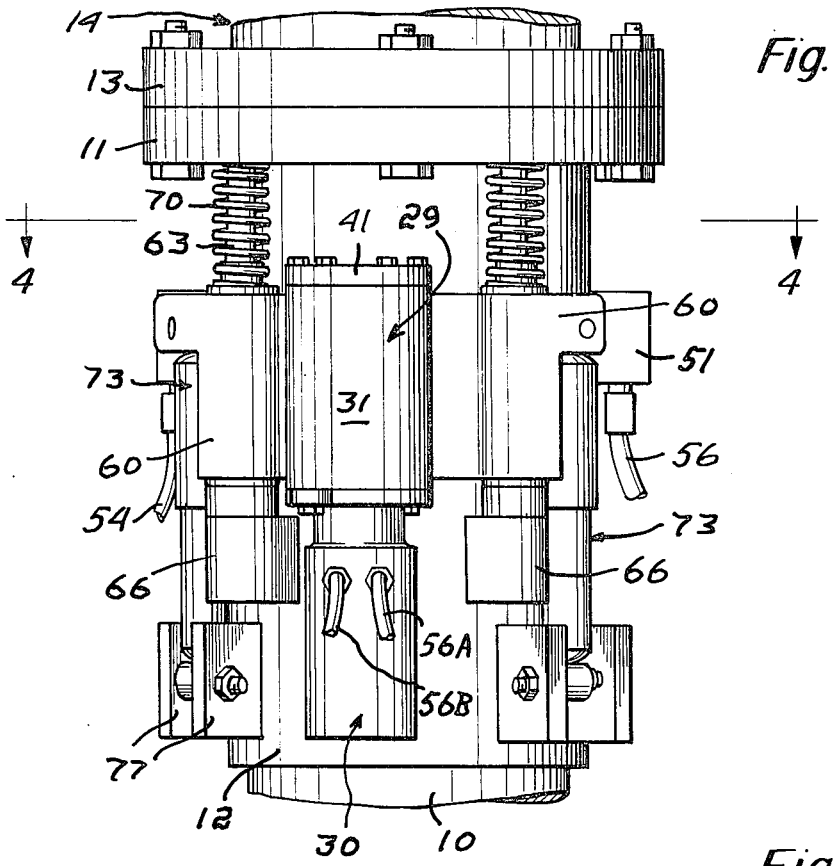
FIG. 3 is a side elevation of the upper end of the mandrel showing the power operated unit by which the retraction cable is operated.

While the mandrel illustrated by the drawings is or may be, except for the means by which a retracting pull is exerted on the retraction cable, identical to that shown in co-pending application Ser. No. 695,259, filed June 11, 1976, the mandrel construction is briefly described to minimize the necessity of making reference thereto.

The mandrel includes a pair of arcuate sections 10 each joined at their upper end by a split flanged plate 11 and provided with a doubler 12 and the lower end of which is engageable with the upper end of the tubular pile, not shown, that is to be driven. The flanged plate 11 is bolted to the lower flange 13 of a drive head, indicated generally at 14.

The mandrel sections 10 are movable towards and away from each other to have pile-entering and pile-gripping relationships. In practice, the mandrel sections are yieldably held in their pile-entering relationship by spring connections spaced lengthwise of the mandrel and omitted as forming no part of the present invention.

The latter, pile-gripping relationship is effected by means operated by fluid under pressure and extending lengthwise of the mandrel in a manner such that the mandrel grips the pile throughout its full length. To this end, the mandrel is provided with a series of groups of sheaves 15 spaced lengthwise of the mandrel with first one sheave connected to one mandrel section 10 and the next connected to the other mandrel section. Each sheave 15 has its mount 16 held between bars 17 fixed on the proximate faces of a pair of lengthwise, transversely spaced reinforcements 18 which define a lengthwise channel in each mandrel section enabling a sheave connected to one section 10 to protrude into the channel of the other section.

Typically and as schematically illustrated by FIG. 2, the number of multi-groove sheaves 15 in each group decreases from a maximum at the boot end of the mandrel to a minimum in the upper end of the mandrel. The upper group or set of sheaves 15 is shown in FIG. 1.

A piston-cylinder unit, generally indicated at 19 has its cylinder 19A supported by the split flange plate 11 and its stem 19B provided with a holder 20 for a single groove sheave 21. An expansion cable 22 looped about the sheave 21 with its ends secured to the holder 20 and the four courses are directed by guide sheaves 23 and 24, both having four grooves and fastened to the same mandrel section into the bottom of the channel of one mandrel section and pass directly to the boot end of the mandrel (not shown) where it is trained about a fixed turning sheave, (not shown), and then upwardly in trained engagement with all the sheaves 15 in a manner such that a pull on the cable 22 tends to straighten it thus forcing the sheaves apart and accordingly forcing the mandrel sections 10 into their pile-gripping relationship. The manner in which the cable 22 is reeved is apparent from FIG. 2 and the cable anchor within the mandrel indicated at 25 in FIG. 1.

As explained in the above referred-to co-pending application, such mandrel expanding means while highly effective in gripping a tubular pile while being driven, not infrequently prevent the return of the mandrel sections to their pile-entering relationship when the mandrel is to be withdrawn from the driven pile.

For that reason, the use of fluid pressure operated retracting means is disclosed in said co-pending application, such means include groups of retraction sheaves 26 spaced lengthwise of the mandrel, each group between two groups of expansion sheaves 15 and with first the holder 27 of a retraction sheave anchored to one mandrel section 10 and the next holder 27 anchored to the other mandrel section. A retraction cable 28 extends downwardly in trained engagement with the sheaves 26 and is connected to an anchor, not shown, near the lower or boot end of the mandrel, the trained engagement of the retraction cable 26 such that a pull thereon tends to straighten it and in so doing forces the mandrel sections 10 to return into their pile-entering relationship.

In the aforesaid application, the means by which a straightening pull on the retraction cable 26 was effected is a piston-cylinder unit. The present invention provides for fluid pressure operated means for the operation of the retraction cable that may be mounted on the outside of the mandrel thus avoiding problems that are encountered with a piston-cylinder unit within the mandrel due to the axial extent thereof.

In the present invention, the cable 26 is under the control of a power operated unit including a winch, generally indicated at 29 and a motor generally indicated at 30 by which the winch is rotated in a cable-winding direction.

It should be here noted that since the lower edge of the mandrel reinforcement of doubler 12 is engageable with the upper end of the tubular pile to be driven, it is desirable and as shown that no part of the winch or motor extend below the doubler 12. For that reason, the use of a piston-cylinder unit is not desirable because of its overall length, particularly when its stem is extended. The winch 29 enables that requirement to be met as does its drive motor 30 and in the disclosed embodiment, a conventional hydraulic motor and accordingly not detailed.

Figure 4:
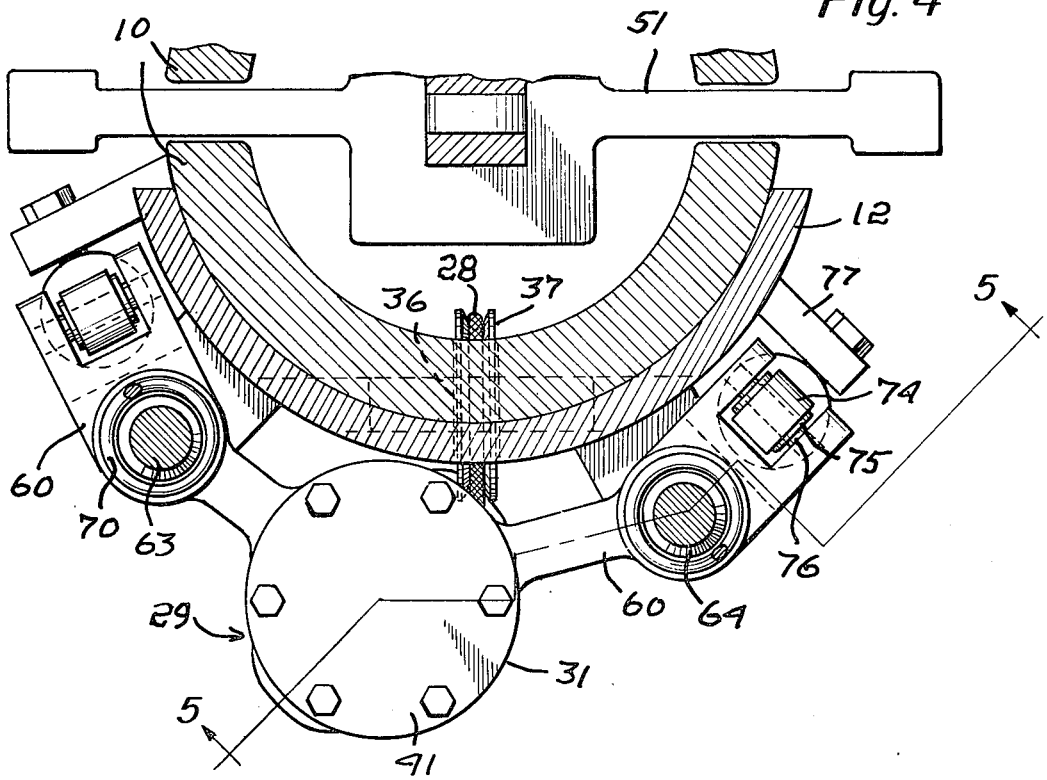
FIG. 4 is a section, on an increase in scale, taken approximately along the indicated line 4—4 of FIG. 3.
Figure 5:
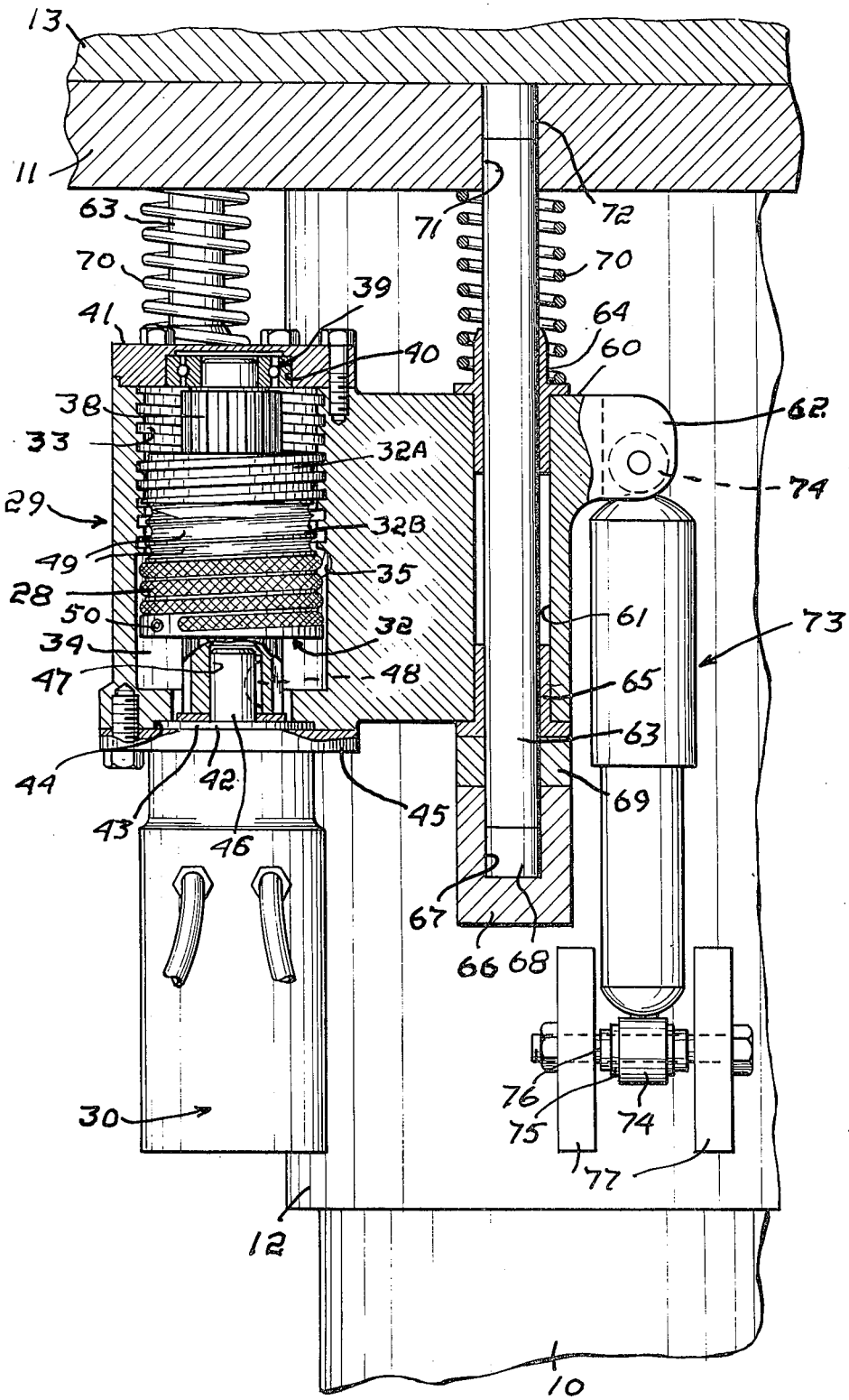
FIG. 5 is a section taken approximately along the indicated line 5—5 of FIG. 4.

The winch housing 31 has a central, vertically disposed bore for the winch drive 32, the bore having an upper threaded section 33, a lower counterbore section 34, and, at the junction of the sections, a cable port 35, see FIG. 5, opening into a vertical slot 36, see FIG. 4, through a doubler 12 and the mandrel section 10 opposite the channel of the other mandrel section 10 in which courses of the cable 22 extend. A sheave 37 is rotatably supported within the slot 36 in a position such that the retraction cable 28, when in trained engagement therewith, passes through the port 35 and extends downwardly along the bottom of the channel of the section 10 by which its sheave 37 is supported.

The drum 32 is slidably splined to a shaft 38, the upper end of which is supported by a ball bearing unit 39 held within the central recess 40 of an end cap 41 detachably secured to the upper surface of the winch housing 31 and its other end rests on a thrust washer 42 backed by a washer 43 fitting the annular recess 44 in the lower surface of the winch housing to which the flange 45 of the hydraulic motor 30 is detachably attached with its drive shaft 46 within an axial socket 47 in the lower end of the shaft 38 with a key and keyway connection 48 between the shafts.

The winch drum 32 has an upper portion 32A threaded in the bore section 33 thus to cause the drum 32 to move axially as it is turned. The lower drum portion 32B, which is a sufficiently free fit within the counterbore section 34 to accommodate the retraction cable 28 wound thereon and which has a spiral groove 49 of a length accomodating the several turns of the cable 28 that result when the mandrel sections are in their pile-entering relationship. The anchor by which the end of the cable 28 is secured to the drum is indicated at 50. The threads of the bore section 30A and of the drum section 29A provide axial movement of the drum 29 such that the exiting or entering cable 28 is always at the same substantially right angular relationship to the axis of the drum 32.

The piston-cylinder unit 19 has an arm 51, the ends of which extend outwardly between the mandrel section 10 and their doublers and include conduits 52 and 53, each having a port inside the mandrel and an outside port. The outside port of the conduit 52 has a hose 54 connected thereto and its inside port has a conduit 55 connected thereto and in communication with the lower end of the cylinder 19A. The inside port of the conduit 53 is in communication with the upper end of the cylinder 19A and its outside port has a hose 56 connected thereto.

The source of oil under pressure, typically located on the ground, is schematically shown in FIG. 2 and it and the valve by which oil under pressure can be delivered through either one of the hoses and returned via the other are conventional and are indicated generally at 57 and 58, respectively. It will be noted from FIG. 2 that the hose 56 has a branch 56A connected to the winch motor 30 so that the motor is operated in a direction to draw in the cable 28 and wind it on the winch drum 32 whenever the control valve 50 is positioned to effect the delivery of oil through the hose 56 when the pile-entering relationship of the mandrel section 10 is wanted. A branch 54A connects the winch motor 30 to the hose 54 so that oil may then flow therefrom back to source but includes a check valve 59 to prevent the delivery of oil to the motor 30 when the valve 50 is positioned to deliver oil under pressure to the unit 19 via the hose 54 to establish the pile-gripping relationship of the mandrel section 10, the branch 56A and the hose 56 then connected by the valve 50 for the return of oil.

Because of the weight considerations, it is necessary to provide protection against the winch and winch motor being damaged as a consequence of acceleration forces as the pile is being driven. To that end, see FIGS. 3 and 4, means are provided to minimize acceleration forces. The drum housing 31 has laterally disposed arms 60 each of which is provided with a vertical bore 61 and at its ends, ears 62. A shaft 63 for each bore 61 extends through upper and lower bearings 64 and 65, respectively. Spaced below the arms 60 are cleats 66, each having a socket 67 provided with an elastomeric bumper 68 and in vertical alignment with an appropriate one of the bores 61. An annular elastomeric bumper 69 encircles each shaft 63 and is confined between the lower bearing 65 and the subjacent cleat 66.

The upper end of each shaft extends through a compression spring 70, and held centered by the upper bearing 64, and into the lower part of a vertical bore 71 extending through the overlying split flange 11 in which there is an elastomeric plug 72 which becomes a bumper when backed by the bottom flange 13 of the drive head 14. The housing 31 and the winch and winch motor are thus attached to the upper end of the mandrel for short vertical movements relative thereto with acceleration forces dampered.

Acceleration forces are further dampered by means of shock absorbers, generally indicated at 73 and not detailed as they may be of any type of appropriate overall length. Each shock absorber 73 has a ring 74 at the end of each of its sections and provided with a bearing 75. The ears 62 at each end of the arms 60 are provided with a pivot 76 extending through a ring bearing 75 at the upper end of a shock absorber 73. Welded to the doublers 11 are pairs of cleats 77 for attaching the lower end of each shock absorber thereto, each pair of cleats holding a pivot 76 extending through a ring bearing 75 at the lower end of a shock absorber thus further ensuring adequate protection of the winch and its drive from damaging acceleration forces.

We claim:

1. An expansible mandrel for use in driving or withdrawing tubular piles and the like, said mandrel comprising sections, a head connected to and joining the upper ends of the sections, said sections being shaped and dimensioned so that they may move towards and away from each other to have a first, pile-entering relationship and a second, pile-gripping relationship, at least one cable within and extending lengthwise of the mandrel with one end connected thereto, first and second series of sheaves within the mandrel, one series for each section and spaced lengthwise thereof, means connecting said sheaves to their respective sections, the cable in such trained engagement with first and second series sheaves that the cable is held sinuous thereby in one of said relationships, the sheave connecting means providing that a straightening pull on the cable exerts force in opposite directions on the two sheave series to force the sections relative to each other into the other of their relationships, said mandrel having an opening in its upper end adjacent said head, and a power operated unit including a winch, a motor connected to the winch drum to rotate it in a winding direction, and means operable to effect the progressive winding of the cable on the drum lengthwise thereof, the other end of said cable connected to said drum, means connecting said unit to the outside of said mandrel with the drum positioned relative to the opening to enable said cable to be secured thereto and wound or unwound therefrom.

2. The expansible mandrel of claim 1 in which the winch motor and the second unit are of a type operated by liquid under pressure, valve controlled means to deliver liquid under pressure to said second unit and including first and second conduits in communication therewith with either return conduit when the other is a delivery conduit, the first conduit when a delivery conduit effecting second units operative to exert a pull on the second cable and the second conduit when a delivery conduit effecting second unit operative to effect the relaxation of said cable, and a conduit effecting communication with said first unit to operate its motor in a direction to wind in the first cable, and a conduit placing said motor in communication with said first conduit and including a check valve operable to block the flow of liquid therethrough when the first conduit is delivering liquid to the second unit.

3. The expansible mandrel of claim 1 in which the winch includes a housing having a cylindrical portion, an internally threaded portion and a port at their junction at said opening, the motor includes a shaft extending axially of said portions to which the winch drum is slidably splined, and the drum includes a cable storage portion and a threaded portion is threaded engagement with the corresponding portion of the casing but of lesser axial extent whereby rotation of said drum results in axial movement thereof with the cable as it is wound on or unwound from said drum always having the same substantially right angular relationship with the drum axis.

4. The expansible mandrel of claim 3 in which the opening is in a mandrel section, a pulley is rotatably supported in said opening with its axis transversely thereof, and said winch housing port is located so that the length of cable between the drum and pulley is horizontal.

5. The expansible mandrel of claim 3 in which the cable storage portion of the drum has a spiral channel.

6. The expansible mandrel of claim 3 in which the drum axis is parallel to that of the mandrel.

7. An expansible mandrel for use in driving or withdrawing tubular piles and the like, said mandrel comprising sections, a head connected to and joining the upper ends of the sections, said sections being shaped and dimensioned so that they may move towards and away from each other to have a first, pile-entering relationship and a second, pile-gripping relationship, at least one cable within and extending lengthwise of the mandrel with one end connected thereto, first and second series of sheaves within the mandrel, one series for each section and spaced lengthwise thereof, means connecting said sheaves to their respective sections, the cable in such trained engagement with first and second series sheaves that the cable is held sinuous thereby in one of said relationships, the sheave connecting means providing a straightening pull on the cable exerts force in opposite directions on the two sheave series to force the sections relative to each other into the other of their relationships, said mandrel having an opening in its upper end adjacent said head, a power operated unit including a winch, a motor connected to the winch drum to rotate it in a winding direction, the other end of said cable connected to said drum, means connecting said unit to the outside of said mandrel with the drum positioned relative to the opening to enable said cable to be secured thereto and wound or unwound therefrom, said connecting means including means operable to minimize the effect on said unit of acceleration forces attendant the driving of a pile by said mandrel.

8. The expansible mandrel of claim 7 and a support to which said unit is secured and which is held by the connecting means for limited lengthwise movement relative to the mandrel.

9. The expansible mandrel of claim 8 in which the support includes two laterally disposed arms, each having a vertical bore and the connecting means include shafts, one for each bore and extending slidably through it with its ends exposed, said mandrel includes a socket in which the ends of the shafts are seated and the means minimizing the effect of acceleration forces includes compression springs held by said shafts between the arms of the support and the sockets receiving the upper ends of the shafts.

10. The expansible mandrel of claim 9 in which the mandrel sections and the head include interconnected flanges and each socket receiving the upper end of a shaft is a bore through a section flange and backed by said head flange.

11. The expansible mandrel of claim 10 and an elastomeric bumper in each socket for both shafts.

12. The expansible mandrel of claim 9 and shock absorbers, one for each arm and connected thereto and to the mandrel below said support.

* * * * *